United States Patent [19]

Daumüller et al.

[11] Patent Number: 4,564,891

[45] Date of Patent: Jan. 14, 1986

[54] VEHICLE HEADLIGHT

[75] Inventors: Hans Daumüller, Bodelshausen; Heinz Ruckwied, Wankheim, both of Fed. Rep. of Germany

[73] Assignee: Robert Bosch GmbH, Stuttgart, Fed. Rep. of Germany

[21] Appl. No.: 718,425

[22] Filed: Apr. 1, 1985

[30] Foreign Application Priority Data

Jun. 1, 1984 [DE] Fed. Rep. of Germany ... 8416804[U]

[51] Int. Cl.[4] ..... F21V 29/00

[52] U.S. Cl. ..... 362/294; 362/306; 362/307; 362/353; 362/396

[58] Field of Search ..... 123/226, 61, 80, 82, 123/296, 306–311, 353, 396

[56] References Cited

U.S. PATENT DOCUMENTS

| | | | |
|---|---|---|---|
| 1,979,968 | 11/1934 | Geiger et al. | 362/306 |
| 2,033,699 | 4/1936 | Frech | 362/306 |
| 3,688,103 | 8/1973 | Daumüller | 362/307 |
| 3,732,415 | 5/1973 | Lindae | 362/226 |
| 3,818,215 | 7/1974 | Schmidt et al. | 362/226 |

*Primary Examiner*—E. Rollins Cross

*Attorney, Agent, or Firm*—Michael J. Striker

[57] ABSTRACT

In a vehicle headlight a lamp holder for holding a bulb in an apex opening of a reflector is formed with three axially extended locking arms having hooks insertable into the slots provided in the reflector. Each slot defines on the surface of the reflector a bearing surface having an insertion portion and an arresting portion. Each hook, upon pivoting of the lamp holder is inserted into the assigned slot and is engaged behind the arresting portion to arrest the lamp holder on the backside of the reflector.

6 Claims, 4 Drawing Figures

VEHICLE HEADLIGHT

BACKGROUND OF THE INVENTION

The present invention relates to a searchlight or headlight for vehicles, particularly motor vehicles.

Vehicle headlights of the type under discussion normally comprise a reflector, into an apex opening of which a bulb is inserted by means of a lamp holder. The bulb is usually sealed against the reflector by a sealing ring. Headlights for motor vehicles of this type have been disclosed for example in applicants' U.S. Pat. Nos. 3,809,880 and 3,688,103.

German patent publication DE-OS No. 3,028,688 discloses a vehicle headlight, in which the fastening of the lamp holder on the backside of the reflector is obtained by means of three reflector tongues which press against the backside of the reflector through flanging of the portion of the lamp holder. This type of fastening, however, requires a non-objectionable feeding of a flanging tool into the apex opening of the reflector, and furthermore, sensitive reflection surfaces of the reflector can be damaged during the flanging process.

SUMMARY OF THE INVENTION

It is an object of the present invention to provide an improved vehicle headlight.

It is another object of this invention to provide a headlight in which the disadvantages of conventional headlights of this type are overcome by simple technical means.

These and other objects of this invention are attained by a headlight for motor vehicles, comprising a reflector with a protective lens; a lamp holder; and a bulb supported in said reflector by said lamp holder, said lamp holder having an outer flange secured to a backside of the reflector, said lamp holder being formed of plastics and having at least three locking arms for locking the lamp holder on said reflector, said locking arms extending approximately parallel to an axis of the reflector, each locking arm including a hook facing toward said axis, said reflector being formed with at least three slots, each slot receiving an assigned arm and defining on said reflector a bearing surface having an insertion portion and an arresting portion, said insertion portion being closer to said axis than said arresting portion, each hook being engaged behind the arresting portion of a respective bearing surface to thereby press the lamp holder against said reflector. Thereby a bayonet-type lock results for securing the lamp holder, made of synthetic plastic material, to the reflector. This bayonet lock requires only three very simple locking arms and three slots in the reflector. The locking arms can be easily manufactured, and the slots and the bearing surface defined thereby can be also made easily by stamping.

A bayonet lock for securing the bulb in an apex opening of the reflector has been disclosed in German patent publication DE-OS No. 2,246,361. This publication shows the bayonet lock which includes two parts or halves, of which one half must be non-releasably secured to the reflector.

Each bearing surface may have between said insertion portion and said arresting portion a radially extending nose which secures the hook of each arm in a locked position of the lamp holder. A non-releasable bayonet lock can be obtained in this embodiment.

The slots may be circumferentially spaced from each other and the locking arms may be circumferentially spaced from each other, respectively.

The slots may be elongated and curved.

The lamp holder may include a flange portion and a collar portion, said locking arms being formed on said outer flange.

The headlight may further include a locking ring securing said collar portion on said bulb.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
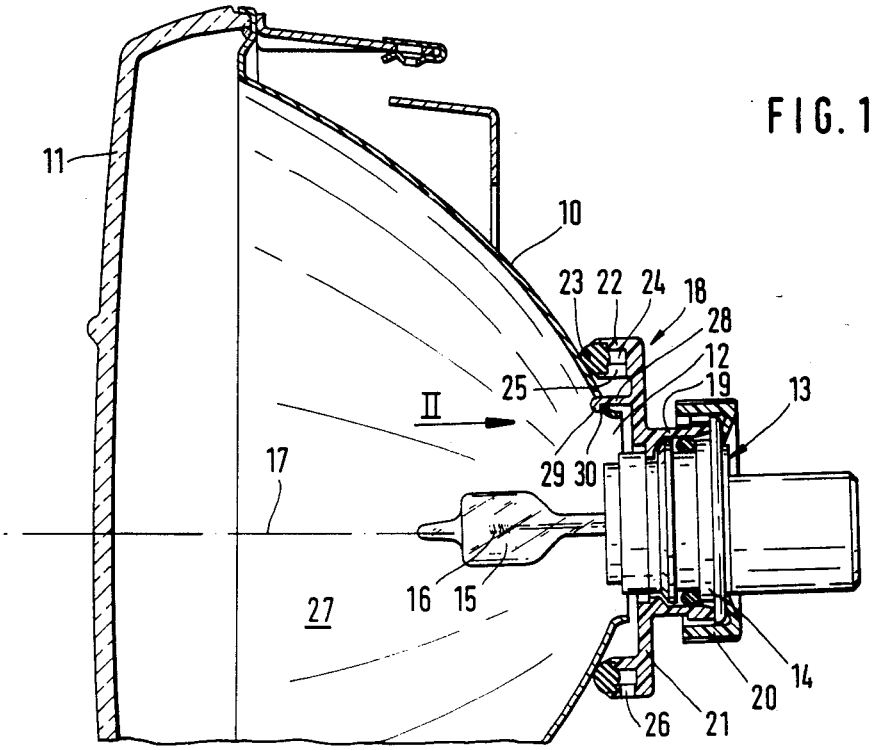
FIG. 1 is a sectional axial view of a vehicle headlight according to the invention.

Referring now to the drawings in detail, and firstly to FIG. 1 thereof, a vehicle headlight according to the invention includes a reflector 10 made of sheet steel and having a protective lens 11 glued to an outlet opening of the reflector. A bulb 13 has a socket 14 formed of plastics and a housing 15 with a filament 16 therein. Housing 15 is secured to socket 14. Filament 16 is arranged approximately on an axis 17 of reflector 10.

A lamp holder 18, made of synthetic plastic material, has a collar or neck portion 19 in which a bulb housing 15 is secured in its functional position by means of a locking ring 20. The lamp holder 18 further includes a ring-shaped plate 21 having an outer flange 22 and being integral, in the exemplified embodiment, with collar 19. The plate 21 has an annular groove 24 which is closed with a sealing O-ring 23. Groove 24 has, on the one hand, a connection with an interior 27 of reflector 10 via an inner opening 25, and on the other hand, a connection with ambient atmosphere via an outer opening 26. The lamp holder 18 has three locking or arresting arms 28 circumferentially spaced from each other. Only one locking arm 28 is seen in FIG. 1. Each locking arm 28 extends approximately parallel to axis 17 and has a hook 29 provided with a radial shoulder 30 and facing toward axis 17.

Figure 2:
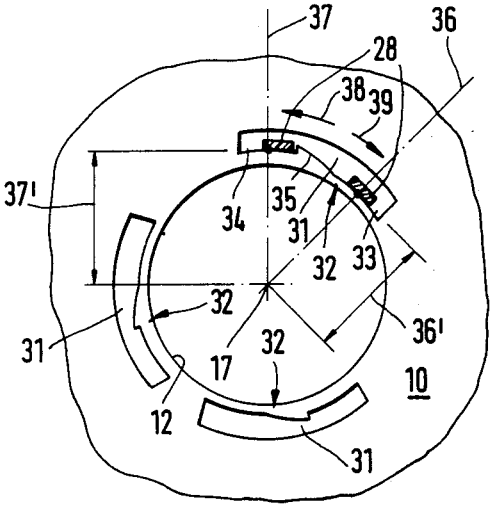
FIG. 2 is a view of an inner surface of a reflector only, taken from arrow 11 of FIG. 1.
Figure 4:
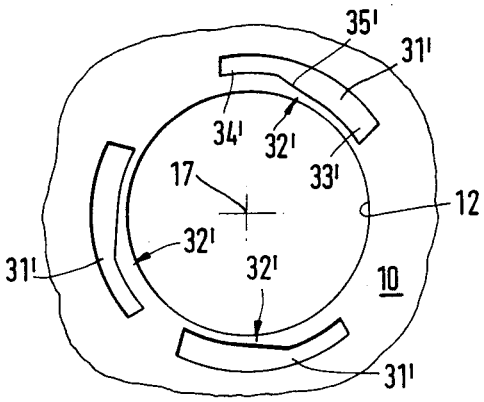
FIG. 4 shows an inner surface of the reflector as viewed from arrow 11 of FIG. 1 but with a modified bayonet lock.

FIGS. 2 and 4 show the reflector 10 which has an apex opening 12 and axis 17 as mentioned above. Three partially curved slots 31, 31' are recessed in reflector 10 in the region of its apex opening 12 so that three bearing surfaces 32, 32' are formed. Each bearing surface 32, 32' has an insertion portion 33, 33' which is positioned closer to the axis 17 and an arresting portion 34, 34' which is positioned remoter from axis 17. As can be seen from FIG. 2 an approximately radially extending projection or nose 35 is formed between each insertion portion 33 and arresting portion 34. A sloping or oblique portion 35' (FIG. 4) connects insertion portion 33' and arresting portion 34' to each other. The only one illustrated locking arm 28 is shown in its insertion position 36 in which it is spaced from axis 17 at a distance 36' and also in its arrested or locked position 37 in which arm 28 is spaced from axis 17 at a distance designated by 37'.

Figure 3:
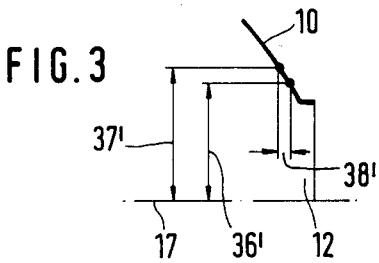
FIG. 3 shows an insertion and an arresting position of a locking hook relative to the headlight reflector.

The bayonet-type lock of the lamp holder operates as follows:

During the pivoting motion of plate 21 in the direction of arrow 38, at which hook 29 engages behind the bearing surface 32, the locking arm 28 is moved from its inserted position 36 to its arresting position 37 whereby a necessary axial displacement 38' (FIG. 3) results so that a surface-contact hermetic sealing via the O-ring 23 occurs against reflector 10.

Projection or nose 35 secures the lamp holder 18 in its locked or arrested position from which a reverse pivoting in the direction of arrow 39 is no longer possible. Such reverse pivoting of the lamp holder 18 is possible in the embodiment of FIG. 4 because the oblique portion 35' is provided on each bearing surface in place of nose 35.

It will be understood that each of the elements described above, or two or more together, may also find a useful application in other types of vehicle headlights differing from the types described above.

While the invention has been illustrated and described as embodied in a vehicle headlight, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlight for motor vehicles, comprising a reflector with a protective lens; a lamp holder; and a bulb supported in said reflector by said lamp holder, said lamp holder having an outer flange secured to a backside of the reflector, said lamp holder being formed of plastics and having at least three locking arms for locking the lamp holder on said reflector, said locking arms extending approximately parallel to an axis of the reflector, each locking arm including a hook facing toward said axis, said reflector being formed with at least three slots, each slot receiving an assigned arm and defining on said reflector a bearing surface having an insertion portion and an arresting portion, said insertion portion being closer to said axis than said arresting portion, each hook being engaged behind the arresting portion of a respective bearing surface to thereby press the lamp holder against said reflector.

2. The headlight as defined in claim 1, wherein each bearing surface has, between said insertion portion and said arresting portion, a radially extending nose which secures the hook of each arm in a locked position of the lamp holder.

3. The headlight as defined in claim 1, wherein said slots are circumferentially spaced from each other and said locking arms are circumferentially spaced from each other.

4. The headlight as defined in claim 3, wherein said slots are elongated and curved.

5. The headlight as defined in claim 4, wherein said lamp holder includes a flange portion and a collar portion, said locking arms being formed on said flange portion.

6. The headlight as defined in claim 5, further including a locking ring securing said collar portion on said bulb.

* * * * *